United States Patent [19]

Boykin

[11] 4,271,616

[45] Jun. 9, 1981

[54] CONTAINER SIGN HOLDER

[76] Inventor: Richard Boykin, 133-20 150th St., Jamaica, Queens, N.Y. 11430

[21] Appl. No.: 952,106

[22] Filed: Oct. 17, 1978

[51] Int. Cl.[3] ..... G09F 3/18

[52] U.S. Cl. ..... 40/11 A; 40/310; 40/606

[58] Field of Search ..... 40/11 A, 23, 21 B, 310, 40/306, 606, 11

[56] References Cited

U.S. PATENT DOCUMENTS

| | | | |
|---|---|---|---|
| 1,357,645 | 11/1920 | Malling | 40/21 B X |
| 2,563,159 | 8/1951 | Clark | 40/10 R |
| 2,976,629 | 3/1961 | Brixius et al. | 40/310 |
| 3,354,564 | 11/1967 | Falcone | 40/310 |

FOREIGN PATENT DOCUMENTS

| | | | |
|---|---|---|---|
| 344192 | 11/1921 | Fed. Rep. of Germany | 40/11 A |
| 86954 | 1/1921 | Switzerland | 40/310 |

*Primary Examiner*—Gene Mancene
*Assistant Examiner*—Wenceslao J. Contreras
*Attorney, Agent, or Firm*—Charles A. Malone

[57] ABSTRACT

An apparatus is disclosed for displaying signs on enclosures which comprises an adjustable flexible material and a means for attaching a rotable member to said adjustable flexible material to which member a means for displaying a sign can be affixed.

4 Claims, 4 Drawing Figures

CONTAINER SIGN HOLDER

BACKGROUND OF THE INVENTION

Since merchandising of products in enclosures began, many methods have been developed for displaying signs on enclosures. These display signs have been used to praise the virtues of the product inside enclosures. Other display signs have been used to advertise the price at which the enclosed merchandise is being sold.

Previously, display signs have been placed on shelves below the place where the enclosed merchandise has been stored for sale. On other occasions, small price tags have been affixed directly to the enclosed merchandise. Other methods of displaying signs on enclosed merchandise (e.g., bottles) meant that a consumer would have to be interested in the merchandise before he would approach the merchandise to determine its cost. This was, in part, due to the limited amount of space available to display signs on the enclosures.

Others have sought to affix pricing labels directly to enclosed merchandise.

OBJECT OF THE INVENTION

One object of this invention is to make it possible for larger display signs to be affixed to enclosures to attract the consumers attention to the enclosed merchandise. This to achieve greater sales.

Another object of this invention is to allow greater flexibility in displaying signs on bottled merchandise.

Still another object of this invention is to allow greater utilization of space when displaying merchandise.

Yet another object of this invention is to make available an inexpensive and versatile method for merchandising products in enclosures without resorting to pricing labels which might fade or become dislodged.

These and other objects will be readily evident upon a study of the following specification and the accompanying drawing.

THE DRAWING

THE DESCRIPTION

Figure 1:
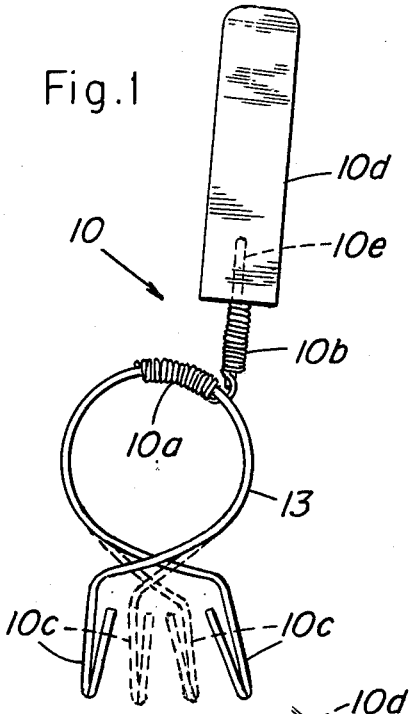
FIG. 1 is a frontal perspective of a preferred embodiment of my invention where the broken lines indicate one method for causing the adjustment of the flexible material around the enclosure.

Referring now to the drawings in greater detail, FIG. 1 shows a preferred embodiment of my invention. Reference numeral 10 represents the apparatus, an adjustable flexible enclosure device. Reference numeral (10*a*) shows a spring hinge at one end which spring fits around the adjustable flexible material (13). The opposite end of (10*a*) forms a pin support spring (10*b*) which serves as a support and rotation means for the display support plate pin (10*e*). The display support plate (10*d*) is affixed to the display support plate pin (10*e*).

FIG. 1 also displays the flexible clasping arms (10*c*) in the flexed and unflexed positions. This figure also displays the apparatus with its display support plate (10*e*) in its downward or flattened position.

Figure 2:
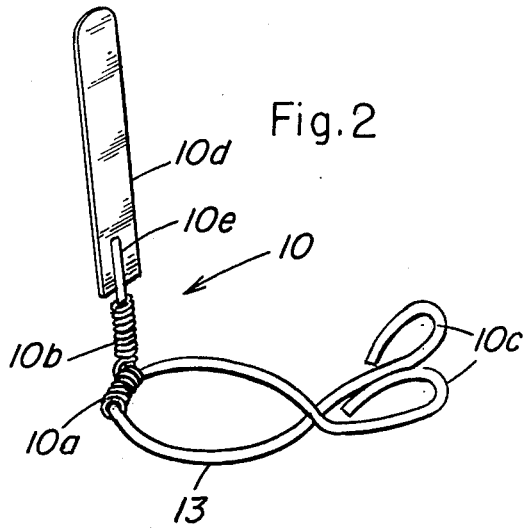
FIG. 2 is a side view of the apparatus with rotable member and display means attached.
Figure 4:
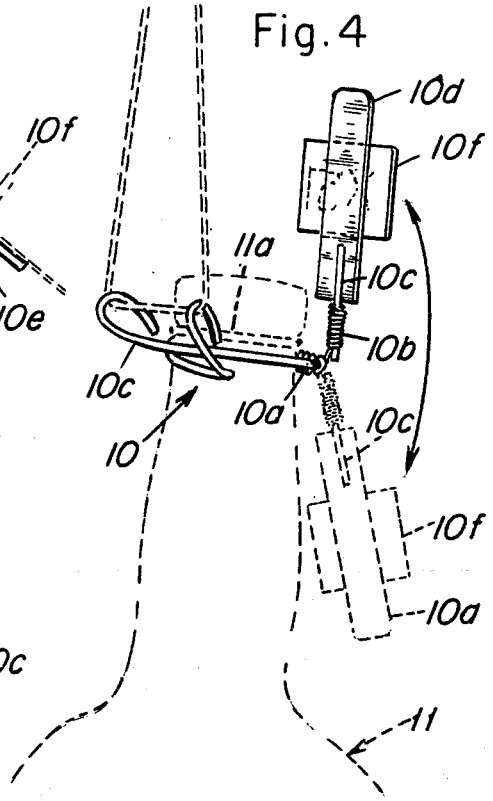
FIG. 4 shows the apparatus affixed to the neck of a suspended bottle neck.

FIG. 2 represents a lateral view of the apparatus with the display support plate in its raised position when it is desired to place the apparatus around an enclosure, e.g., a bottle (11), as shown in FIG. 4, the flexible clasping arms (10*c*) are used to adjust the opening to fit around the bottle. When released the apparatus fits snugly around the bottle. By placing tension on the display support plate (10*d*) the spring hinge is caused to rotate on the adjustable flexible material (13) thus causing it to be raised or lowered. This is represented in FIGS. 1 and 2.

Figure 3:
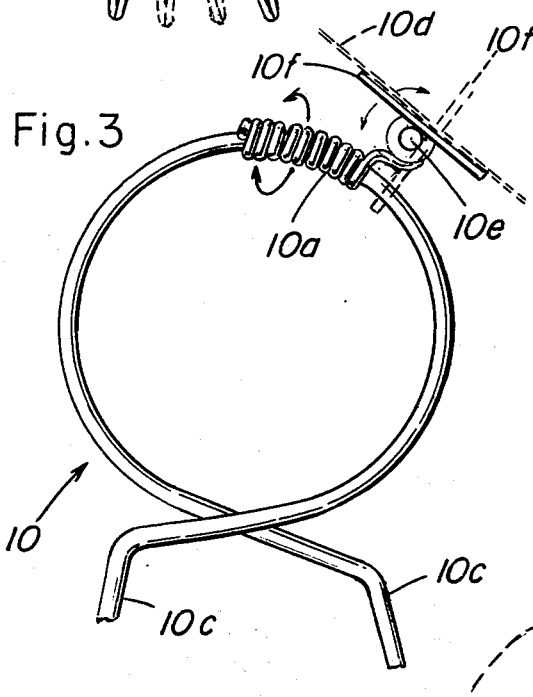
FIG. 3 is a top view of the same apparatus, which demonstrates the rotability of the rotable member and display means.

By rotating the display support plate pin (10*e*) in the pin support spring (10*b*), the display plate (10*f*) can be positioned at various angles. FIG. 3 is a representation of these various angles.

Should it be desired to suspend an enclosure, e.g., a bottle from a ceiling or other location for merchandising effect or because of space shortages, this can be done by placing a string or similar material through the flexible clasping arms (10*c*). As the apparatus is placed below the bottle rim (11*a*) it is prevented from becoming dislodged. FIG. 4 depicts the bottle (11) suspended. It further shows the display plate (10*f*) in various positions.

These drawings represent one embodiment of my invention. Other embodiments will become readily apparent to one skilled in the art. While various changes may be made in the detail construction, it is understood that such changes will be within the spirit and scope of the present invention.

What is claimed:

1. An apparatus for displaying signs on containers which comprises:

(a) a substantially round adjustable flexible material forming a substantially circular configuration where one end of said flexible material crosses the other and each end bends at an obtuse angle from the other end, terminating in an upward oval shape; and (b) a coiled double spring hinge where one coil encircles and is moveably affixed to said adjustable flexible material forming about a right angle with the other coil which encircles and is moveably affixed around a pin containing a rectangular plate which spring allows the plate to be rotated in a multiplicity of directions.

2. An apparatus as claimed in claim 1 where the rectangular plate is fittingly adopted to receive a display sign.

3. An apparatus as claimed in claim 2 where the upward oval shape of the adjustable flexible material comprises a means for suspending a bottle.

4. An apparatus as claimed in claim 3 where the means for suspension comprises a string.

* * * * *